US010390128B2

(12) United States Patent
Fathollahi

(10) Patent No.: US 10,390,128 B2
(45) **Date of Patent: *Aug. 20, 2019**

(54) AUDIO SPEAKER WITH EXTERNALLY REINFORCED PASSIVE RADIATOR ATTACHMENT

(71) Applicant: Zagg Amplified, Inc., Midvale, UT (US)

(72) Inventor: Andy Fathollahi, Corona Del Mar, CA (US)

(73) Assignee: ZAGG Amplified, Inc., Salt Lake City, UT (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/051,617

(22) Filed: Feb. 23, 2016

(65) Prior Publication Data

US 2016/0173973 A1 Jun. 16, 2016

Related U.S. Application Data

(63) Continuation of application No. 14/502,460, filed on Sep. 30, 2014, now Pat. No. 9,271,098.

(60) Provisional application No. 61/887,876, filed on Oct. 7, 2013.

(51) Int. Cl.

| | |
|---|---|
| ***H04R 1/28*** | (2006.01) |
| ***H04R 31/00*** | (2006.01) |
| ***H04R 1/02*** | (2006.01) |
| ***H04R 9/06*** | (2006.01) |

(52) U.S. Cl.

CPC ..... *H04R 1/2834* (2013.01); *H04R 1/023* (2013.01); *H04R 1/026* (2013.01); *H04R 9/06* (2013.01); *H04R 31/003* (2013.01); *H04R 1/028* (2013.01); *H04R 2420/07* (2013.01); *H04R 2499/13* (2013.01); *Y10T 29/49005* (2015.01)

(58) Field of Classification Search

CPC ..... H04R 1/00; H04R 2205/022; H04R 2201/401; H04R 2201/405; H04R 1/2815; H04R 1/2826

USPC ..... 381/349, 182

See application file for complete search history.

(56) References Cited

U.S. PATENT DOCUMENTS

| | | | | |
|---|---|---|---|---|
| 3,669,215 | A | 6/1972 | Kikuchi | |
| 4,206,830 | A | 6/1980 | Sohma et al. | |
| 4,332,986 | A | 6/1982 | Butler | |
| 4,593,659 | A | 6/1986 | Wells et al. | |
| 4,887,690 | A | 12/1989 | Patel | |
| 4,939,783 | A * | 7/1990 | Dunning | H04R 1/2873 381/349 |
| 5,740,259 | A | 4/1998 | Dunn | |
| 6,104,823 | A * | 8/2000 | Tanaka | H04R 5/02 181/199 |

(Continued)

*Primary Examiner* — Suhan Ni

(74) *Attorney, Agent, or Firm* — Durham Jones & Pinegar; Sarah W. Matthews; Randall B. Bateman

(57) ABSTRACT

A battery powered wireless audio speaker comprising a passive radiator is disclosed. The perimeter portion of the passive radiator is sandwiched between the speaker chassis and the retention gasket that resides between an external overlying perforated cover to firmly secure the passive radiator. The construction is capable of being well suited to enhance and improve integrity to the seal between the passive radiator and the speaker chassis in strenuous environment conditions such as when a speaker is submerged in water.

20 Claims, 11 Drawing Sheets

(56) References Cited

U.S. PATENT DOCUMENTS 6,212,284 B1 * 4/2001 Puls ..... H04R 1/24 381/182
6,389,146 B1 * 5/2002 Croft, III ..... H04R 1/2842 381/349
6,504,938 B1 * 1/2003 Anderson ..... H04R 1/2849 381/349
6,626,263 B2 * 9/2003 Sahyoun ..... H04R 1/2834 381/349
6,658,129 B2 * 12/2003 D'Hoogh ..... H04R 7/08 381/349
6,704,426 B2 * 3/2004 Croft, III ..... H04R 1/2842 381/349
D561,170 S 2/2008 Koike
7,400,910 B2 * 7/2008 Matsumoto ..... H04M 1/03 381/345
7,454,025 B2 * 11/2008 Saiki ..... H04R 1/2819 381/349
7,565,948 B2 7/2009 Parker et al.
7,584,820 B2 9/2009 Parker
7,689,197 B2 3/2010 Luade et al.
8,094,842 B2 1/2012 Noro et al.
8,160,286 B2 * 4/2012 Koike ..... H04R 7/06 381/349
8,184,826 B2 * 5/2012 Matsumura ..... H04R 1/2803 381/349
8,315,416 B2 * 11/2012 Lee ..... H04M 1/6033 381/300
8,428,284 B2 4/2013 Meyer et al.
8,430,201 B1 4/2013 Weidner
8,459,404 B2 6/2013 Murray et al.
D718,741 S * 12/2014 Lui ..... D14/216
2001/0031061 A1 * 10/2001 Coombs ..... H04R 1/2826 381/349
2004/0084244 A1 5/2004 Zurek et al.
2006/0291684 A1 12/2006 Chick et al.
2007/0092096 A1 * 4/2007 Litovsky ..... H04R 1/2834 381/349
2009/0318198 A1 12/2009 Carroll
2010/0081379 A1 * 4/2010 Cooper ..... H01Q 1/248 455/41.1
2014/0152890 A1 6/2014 Rayner
2015/0245122 A1 8/2015 Rayner et al.

* cited by examiner

AUDIO SPEAKER WITH EXTERNALLY REINFORCED PASSIVE RADIATOR ATTACHMENT

INCORPORATION BY REFERENCE TO RELATED APPLICATION

This application is a continuation of U.S. application Ser. No. 14/502,460, filed Sep. 30, 2014, which claims benefit under 35 U.S.C. § 119(e) from U.S. Provisional Application No. 61/887,876, filed on Oct. 7, 2013. All of the above applications are hereby incorporated herein by reference in their entirety and are to be considered a part of this specification.

FIELD

This patent application generally relates to audio speakers, and more specifically to audio speakers having one or more passive radiators.

BACKGROUND INFORMATION

Conventional speakers are generally comprised of an internal compartment defined by a chassis or from having one or more main drivers ("active driver") mounted thereon. Often electronic circuitry that controls the speaker is contained within the internal compartment. Some speakers also employ a passive radiator (or a drone cone) that is also mounted on the chassis. The passive radiator is typically the same or similar to the main driver, but without a voice coil and magnet assembly. When the main driver and the passive radiator are both mounted to a sealed speaker compartment, the movement of the main driver fluctuates the internal air pressure within the compartment causing the passive radiator to fluctuate with sound.

In order to have a consistent and desired tune, the passive radiator needs to be properly mounted to the chassis in a manner that maintains the integrity of the compartment seal so that the pressure differential required to fluctuate the passive radiator in the desired manner is maintained. In conventional manufacturing constructions, the outer perimeter portion of the passive radiator is efficiently mounted to the speaker chassis with an adhesive. The adhesive secures the inner side of the perimeter portion of the passive radiator to an underlying corresponding perimeter support structure on the chassis. A sealed internal compartment is thus formed between the chassis and the passive radiator. The sealed internal compartment serves the dual purpose of protecting the external electronics from exposure to the environment while also allowing the active driver to fluctuate the air pressure within the internal compartment to energize the passive radiator.

These days wireless speakers, often battery powered such as those marketed by applicant under the BRAVEN brand, are common. Such speakers are being used more and more in various indoor and outdoor environments including camping, hiking, travel, leisure, beach, boating, and other rugged and potentially weather and water prone environments. Applicants here have found that over time, perhaps as a result of use and/or environment, a portion of the passive radiator may detach from the speaker chassis. This may be caused, for example, by water pressure on the passive radiator when the speaker falls or is otherwise submerged in water. Detachment of the passive radiator can result in damage to the electrical components (e.g., voice coil and magnet assembly of the active driver and other control circuitry located in the enclosure) and poor performance. Accordingly, as recognized by applicants, there is a need to improve the integrity of the attachment of the passive radiator while also allowing the speaker to be efficiently manufactured and assembled.

SUMMARY

The subject matter of this invention is generally directed to an improved speaker assembly and methods of manufacture. The speaker may be designed to resist water penetration, may receive audio signals wirelessly, and/or may be battery powered. The speaker assembly includes a frame or chassis and one or more active drivers and at least one passive radiator mounted thereon, which when assembled together define an internal compartment. Support members are provided on opposing surfaces of the perimeter portion of the passive radiator to sandwich and secure the passive radiator in the desired position.

In one construction, the chassis includes an aperture that has a radial region that generally corresponds in shape and dimension of the perimeter portion of the passive radiator. The radial region is configured to interface with the inner surface of the perimeter portion of the passive radiator to provide internal support thereto. The speaker also includes one or more perforated cover plates dimensioned and otherwise configured to attach to the speaker chassis and overlie the enclosure of the speaker cones and/or passive radiator. A retention gasket corresponding in dimension with the radial support region of the chassis aperture is positioned on top of the perimeter portion of the passive radiator in opposing position to the radial region of the aperture directly underlying the perimeter portion of the passive radiator.

The retention gasket may be independent and/or integral with the inner region of the perforated cover plate overlying the passive radiator. The retention gasket and cover plate being dimensioned to firmly secure the passive radiator into the desired position by firmly sandwiching the perimeter portion of the passive radiator between the radial region of the aperture and the distal surface of the retention gasket.

The passive radiator/chassis seal can be water tight and further reinforced with mechanical means such as screws or adhesives.

Such constructions are capable of providing improved protection against water, moisture or contaminants from passing into the internal compartment while also capable of being efficiently manufactured.

DESCRIPTION OF THE DRAWINGS

The details of the invention, both as to its structure and operation, may be gleaned in part by study of the accompanying figures, in which like reference numerals refer to like parts. The components in the figures are not necessarily to scale, emphasis instead being placed upon illustrating the principles of the invention. Moreover, all illustrations are intended to convey concepts, where relative sizes, shapes and other detailed attributes may be illustrated schematically rather than literally or precisely.

DESCRIPTION OF EMBODIMENTS

Disclosed herein are stereo speakers that include one or more active drivers and at least one passive radiator. The embodiments disclosed herein are described in the context of a wireless, battery powered, mobile stereo speaker as such speakers are of the type commonly used in outdoor environments. However, it should be understood that the teachings herein may be applied to other types of speakers and the mount described herein with regards to the passive radiator may also be employed with respect to other external mounted components such as the active drivers or radiators. In addition, it should be understood that the teachings herein can be applied to more than stand-alone speakers. Indeed, it is contemplated that the teachings herein are equally applicable to any device that employs a passive radiator including and not limited to keyboards, computers, cameras, PDAs, and cell phones or waterproof/water-resistant or protective cases therefore.

Figure 1:
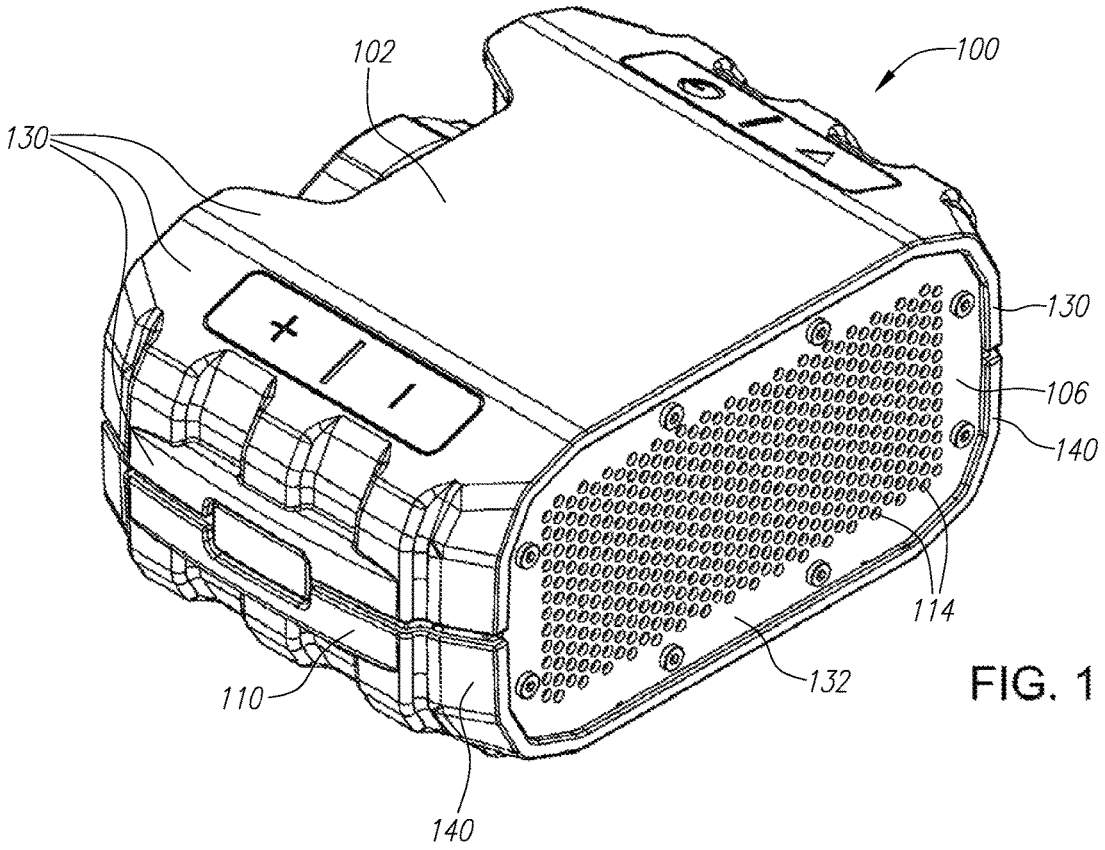
FIG. 1 is an isometric view of an exemplary fully-assembled stereo speaker showing the top, left, and front side thereof.
Figure 2:
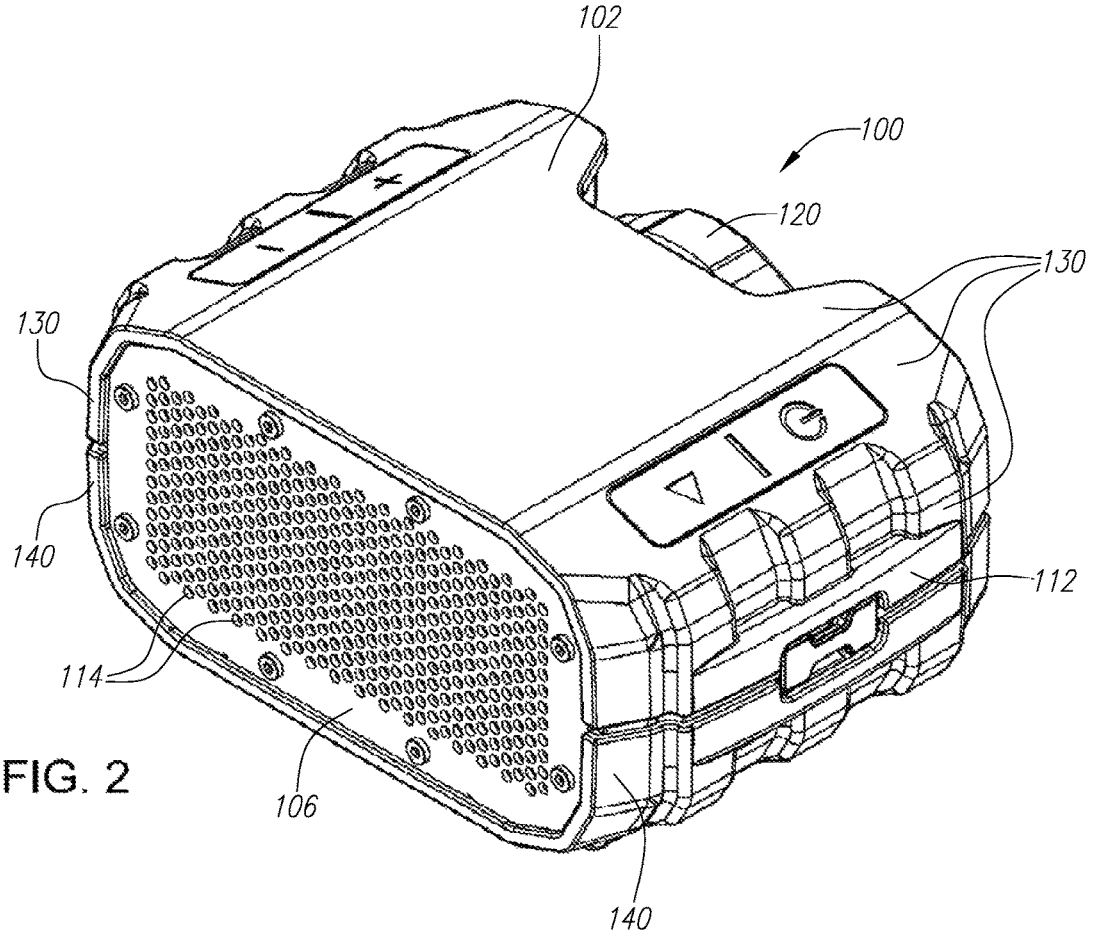
FIG. 2 is an isometric view of the stereo speaker of FIG. 1 showing the top, right and front side thereof.
Figure 3:
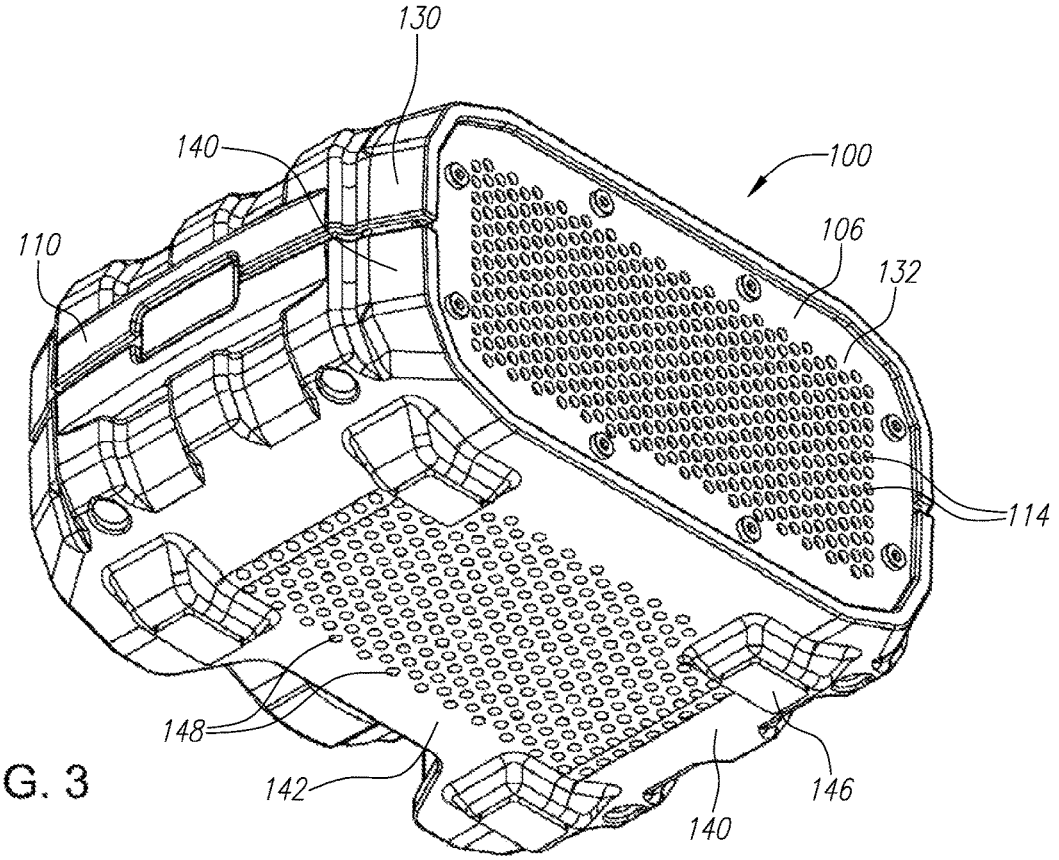
FIG. 3 is an isometric view of the stereo speaker of FIG. 1 showing the bottom, left and front side thereof.
Figure 4:
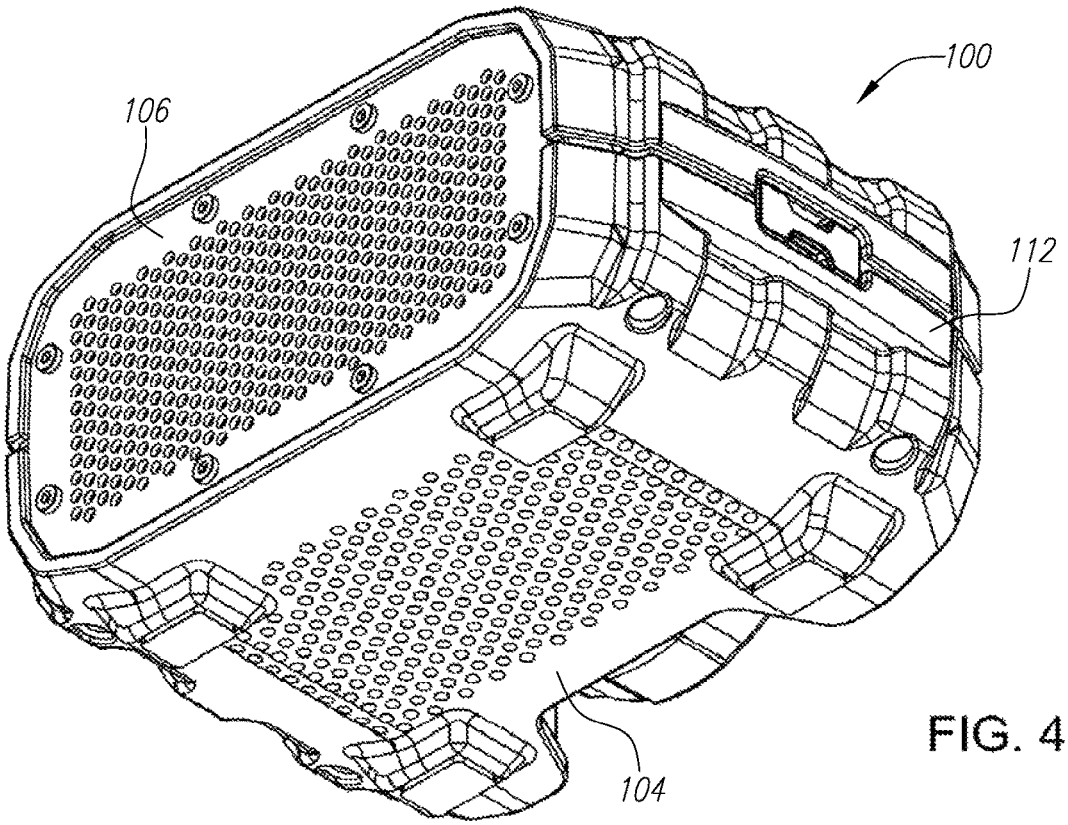
FIG. 4 is an isometric view of the stereo speaker of FIG. 1 showing the bottom, right and front side thereof.
Figure 5:
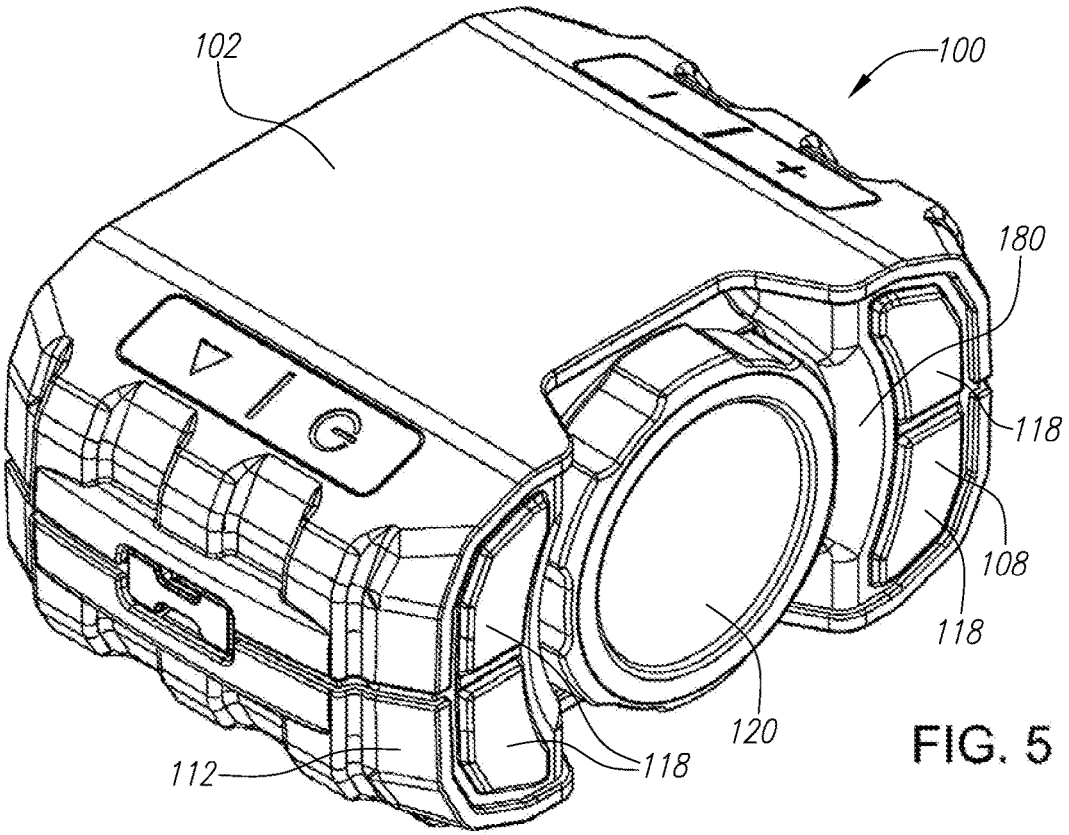
FIG. 5 is an isometric view of the stereo speaker of FIG. 1 showing the top, rear and right side thereof.
Figure 6:
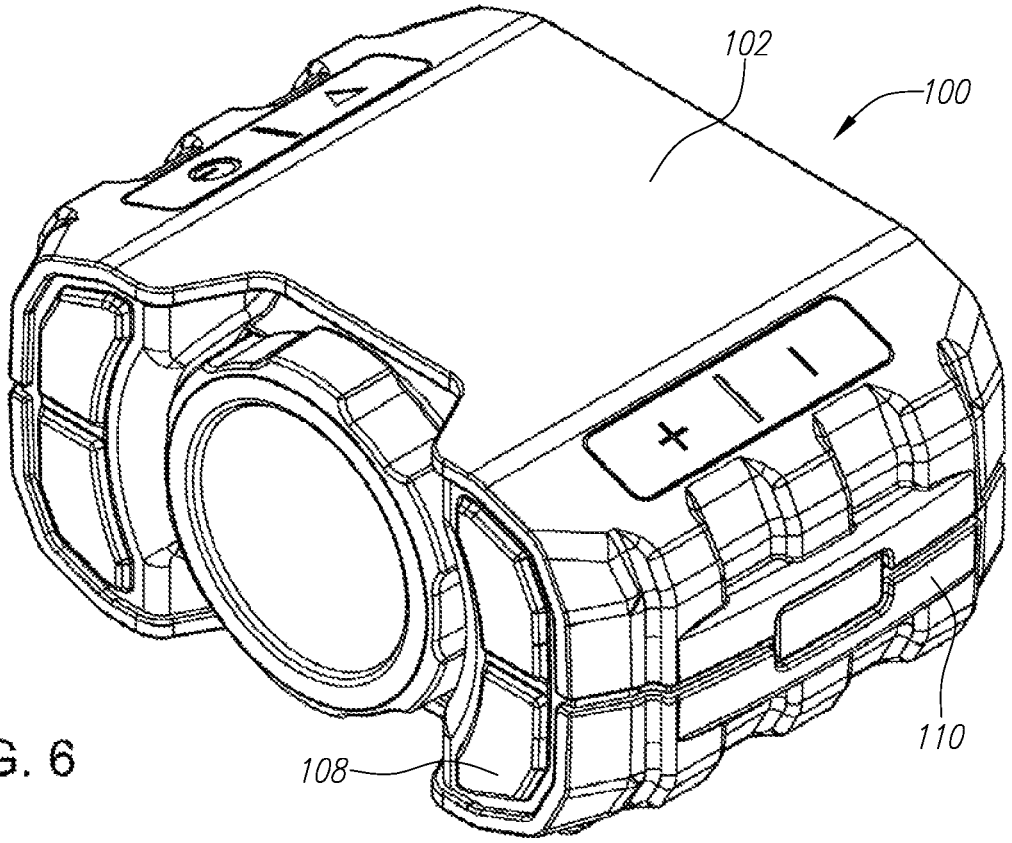
FIG. 6 is an isometric view of the stereo speaker of FIG. 1 showing the top, rear and left side thereof.
Figure 7:
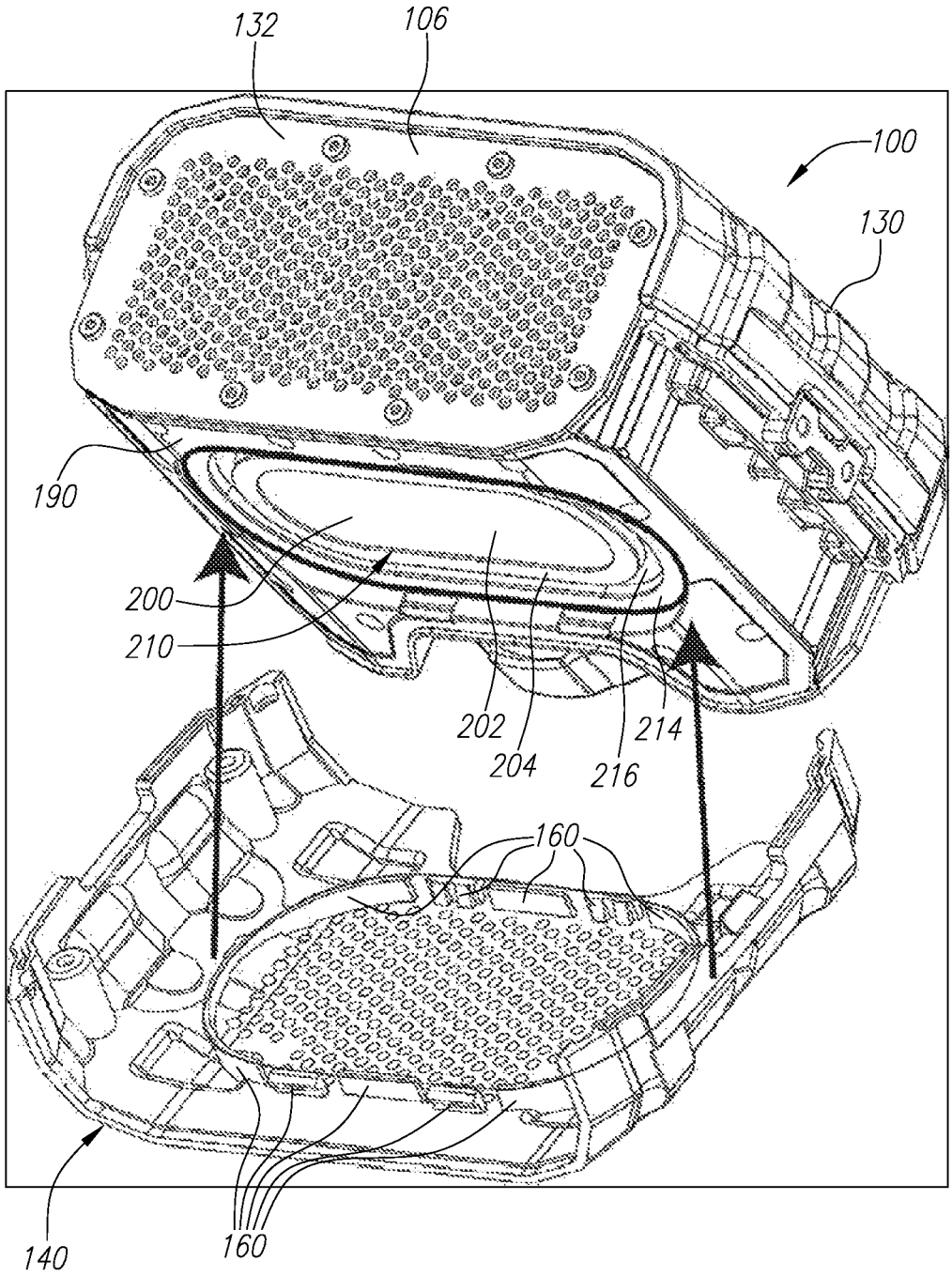
FIG. 7 is a perspective view of the stereo speaker of FIG. 1 with the bottom cover removed from the speaker chassis to reveal the passive radiator and retention gasket.
Figure 8:
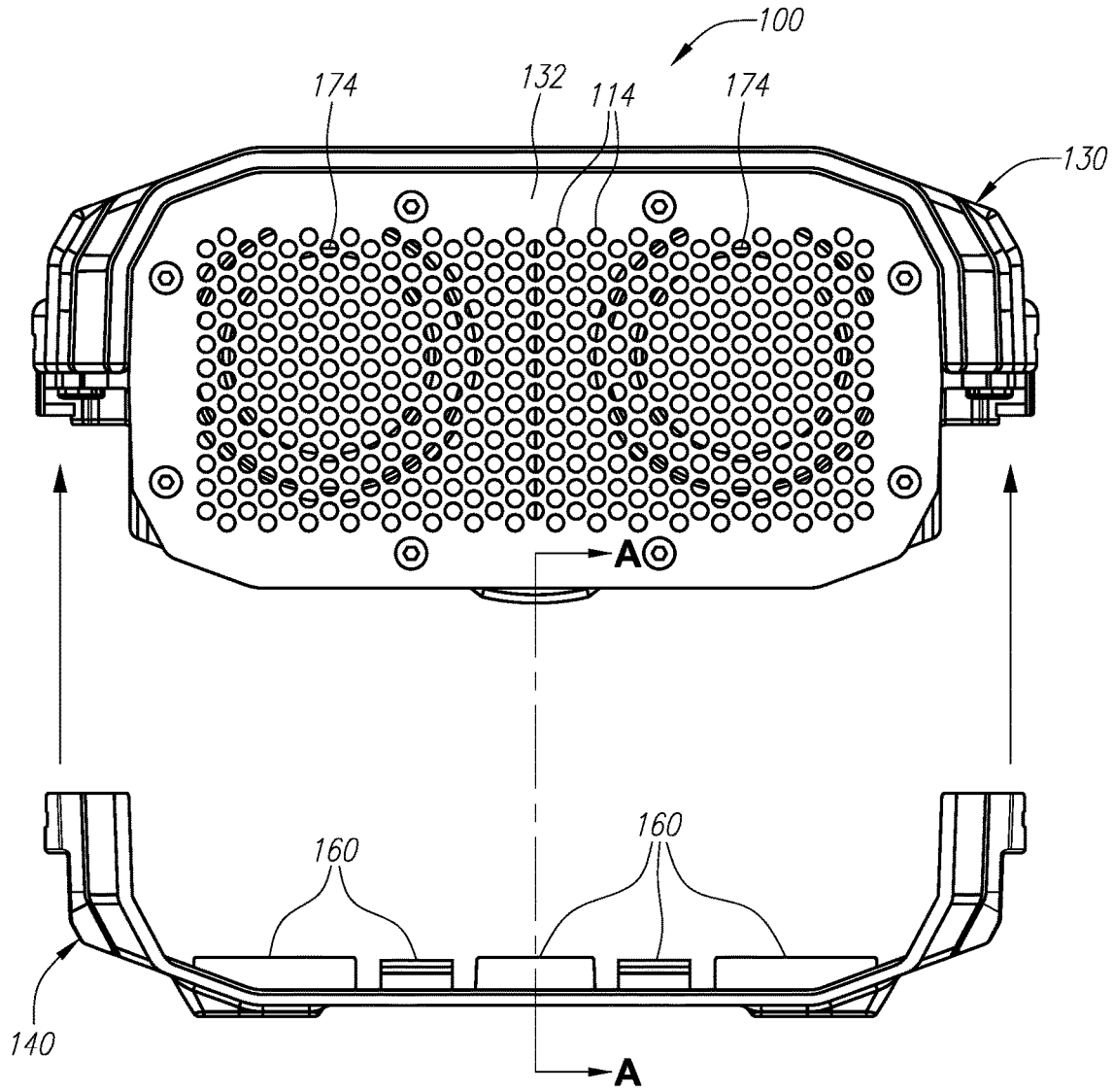
FIG. 8 is a front view of the stereo speaker of FIG. 1 with the bottom cover removed from the speaker chassis to reveal a longitudinally extending region of the passive radiator retention gasket on the inside of the bottom cover.
Figure 9:
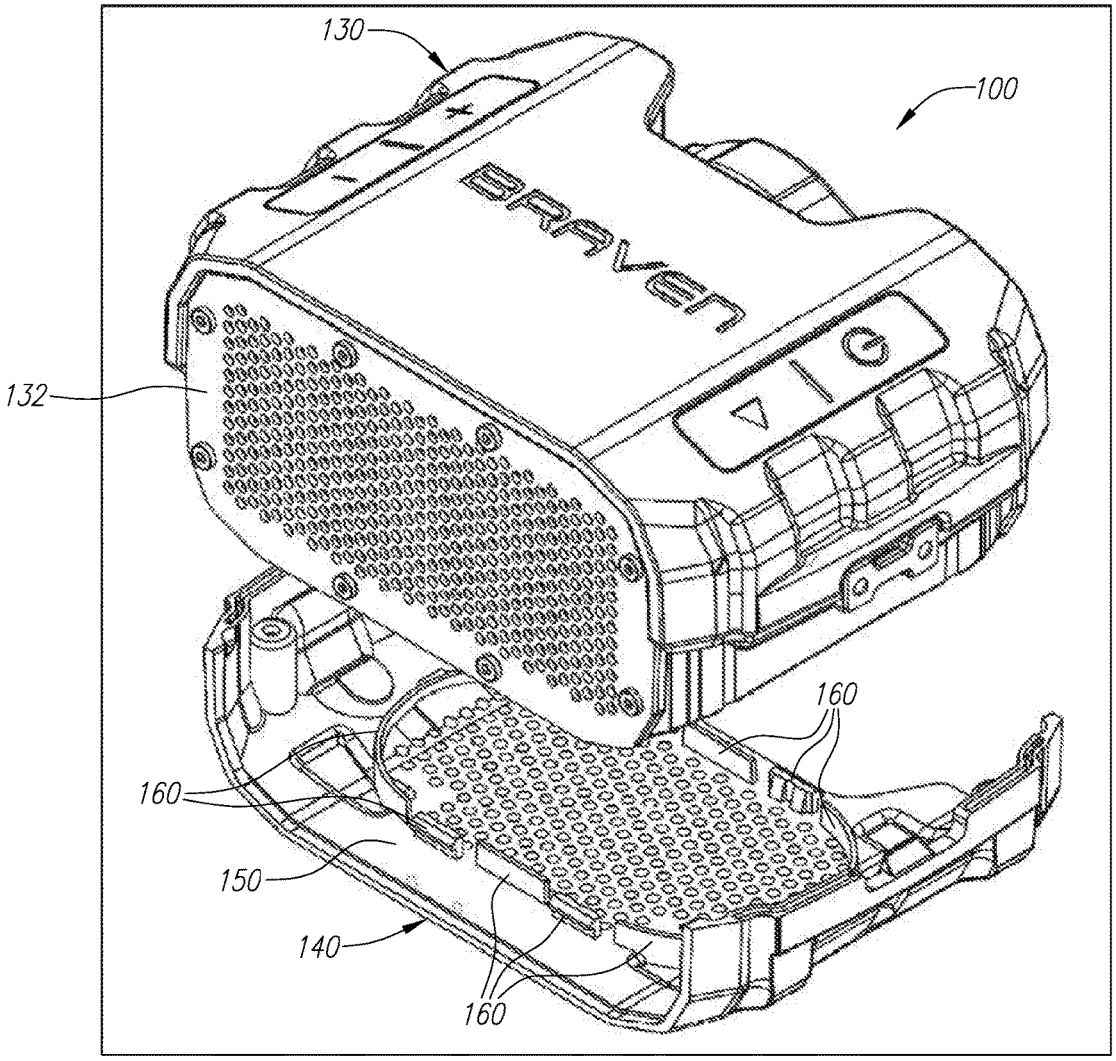
FIG. 9 is a top perspective view of the stereo speaker of FIG. 1 with the bottom cover removed from the speaker chassis to reveal a perspective view of the passive radiator retention gasket on the inside of the bottom cover.
Figure 10:
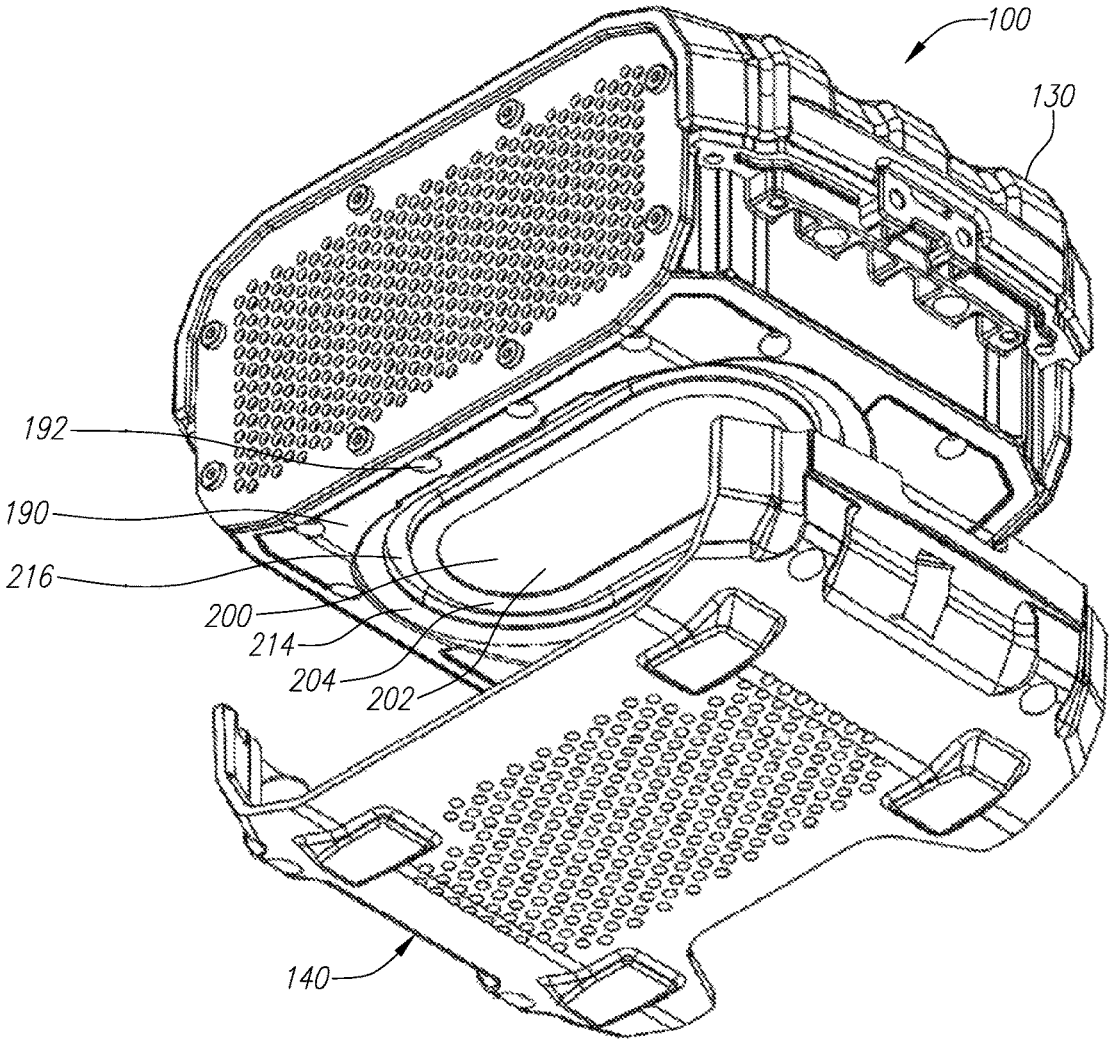
FIG. 10 is another bottom perspective view of the stereo speaker of FIG. 1 with the bottom cover portion removed from the speaker chassis to reveal the passive radiator and the surrounding speaker chassis.
Figure 11:
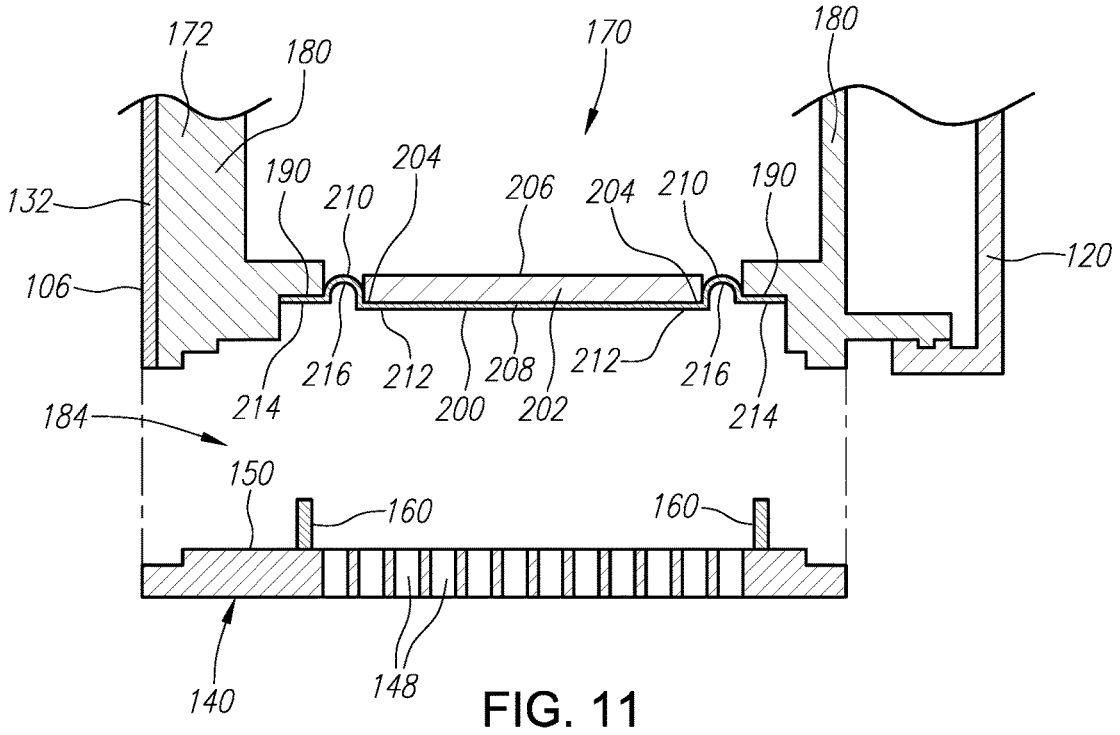
FIG. 11 is a cross-sectional view taken along A-A of FIG. 8 that further illustrates the passive radiator, the underlying radial support region of the speaker chassis and the overlying retention gasket.
Figure 12:
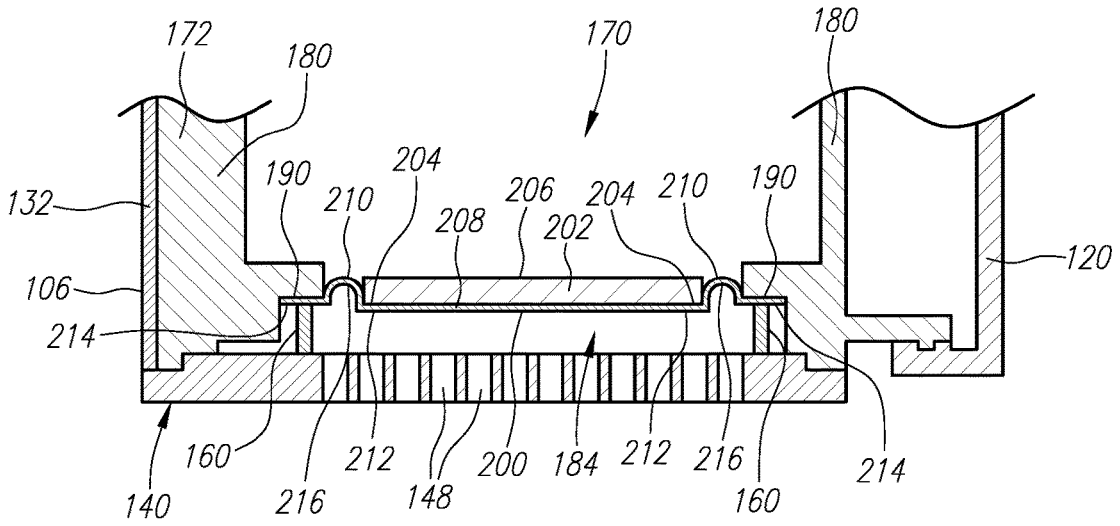
FIG. 12 is a cross-sectional view of FIG. 11 wherein the bottom cover is attached to the speaker chassis to further illustrate the relative position of the passive radiator, the underlying radial support region of the speaker chassis and the overlying retention gasket in the assembled state.

FIGS. 1-6 illustrate an embodiment of an exemplary fully-assembled stereo speaker 100. FIGS. 7-10 illustrate the exemplary speaker in a partially disassembled state with the bottom cover removed and FIGS. 11-12 illustrate cross-section views of the exemplary speaker 100 and the support and attachment structure of the passive radiator 200.

In the exemplary embodiment, the speaker is waterproof, wireless, battery powered and mobile. As used herein the term waterproof means that it is capable of withstanding immersion in one meter of water for up to 30 minutes consistent with IEC standard 60529 IPX7. Speaker 100 is depicted as being in the shape of generally rectangular box with rounded corners, however, it should be understood that the speaker 100 may take any shape desired. In the preferred embodiment the speaker is readily transportable by the user having dimensions approximately 5 inches in length, 2.5 inches in height, and 3.5 inches depth and approximately one pound in weight.

The speaker 100 includes a top side 102, a bottom side 104, a front side 106, a rear side 108, a left side 110, and a right side 112 that surround an internal housing. The front side 106 includes a perforated 114 front cover 132 that covers the active driver 174 (shown in FIG. 8 through the perforations 114). The perforations/holes 114 are provided to allow sound waves, generated by the vibration of an active driver 174 to pass through. Although not fully depicted the active drivers 174 are generally circular cone radiators mounted on the front side 172 of the speaker chassis 180. The front cover 132 is removably attached to the chassis 180 via mechanical means such as screws or latches or via adhesive means or a combination thereof. The chassis 180 provides the primary support structure of the speaker 100 to mount the speaker radiators within apertures therein and defines the internal compartment 170.

In a preferred embodiment of particular relevance for waterproof or water resistant implementations, the chassis 180 may be a unitary integrally formed polymer molded or extruded construct with multiple apertures for the speaker radiators and any other passage required, such as USB communication or charging port, power connector, audio connector, Ethernet connection, reset or control buttons or indicators, battery power indicator or controls, which in the present embodiment may be housed under the screw-on cap 120 that mates with the chassis 180 and protects the electrical sockets and interfaces thereunder.

The chassis 180 is preferably formed of suitably rigid material that is capable of withstanding external pressure and maintaining the desired tune of the speaker. Portions of the chassis 180 may be externally exposed while other portions may underlie covers (e.g., 132 front cover, 140 bottom covers), caps (e.g. 120) and/or may be overlaid, over-molded, or co-molded with another, perhaps more flexible, elastic, less rigid, or cushioning material. Thus, this second material may allow for pushbutton external control such as volume, power or play control while also providing a protective cushioning layer for impact. In the illustrated embodiment, the less rigid, elastic polymer layer covers the top of the chassis 180 along the top region 130 (including over the volume, power, and play user control buttons), in rear regions 118, and the outside of the bottom cover 140, discussed in more detail below. The perimeter edge region of the front side 106 may also be overlaid with a protective cushioning layer as well as the left and right side 110 and 112 regions or protrusions thereon.

The bottom cover 140 includes an internal side 150 and an external side 142 is configured to be removably attached to the underside or bottom of the chassis 180 for example by mechanical means, e.g., screws, rivets, or latches or the like. The external side 142 may include a plurality of feet 146 to provide a support for the speaker 100 in the upright position. As with the front cover 132, the bottom cover 140 is perforated with a plurality of holes 148 for allowing sound waves, generated by the vibration of a passive radiator 200 (shown in FIGS. 7 and 10-12), to radiate externally from the internal compartment 170. The passive radiator 200 can be the same or similar to the main or active drivers 174 but without a voice coil and magnet assembly. The physical forward/back movement of the main driver 174 fluctuates the air pressure in the sealed internal compartment 170, which in turn fluctuates the passive radiator 200 to generate sound.

In the exemplary speaker, the passive radiator 200 is generally in the shape of an elongated oval and includes a relatively rigid central region 202 and a relatively flexible region 210 that extends radially from the outer perimeter portion 204 of the central region 202 to the radial perimeter portion 214 of the flexible region 210. The flexible perimeter region 210 includes one or more perimeter baffles 216 to allow the radiator to pulsate inward and outwardly with movement as it fluctuates with sound. The central part 202 may include a rigid tuning mass 206 and external elastic or flexible skin or layer 208 overlaid thereon that extends radially to form the flexible region 210 including the radial perimeter portion 214.

The radial perimeter portion 214 of the flexible element 210 is mounted to the chassis 180 within a correspondingly dimensioned passive radiator aperture therein which is defined as residing between radial region 190 of the aperture chassis. When mounted, the radial perimeter portion 214 of the passive radiator 200 overlies the externally facing surface of the radial region 190. The inner surface of the radial perimeter portion 214 of the passive radiator 200 may be glued or adhered to the outer surface of the radial region 190 of the chassis 180. In a preferred construction an elastic epoxy or rubber glue is used. Once the passive radiator is attached to the bottom portion of the chassis 180 (or in the case of a multi-part chassis, the bottom portion of the chassis positioned and attached to the other mating portion of the chassis) the internal compartment 170 is sealed.

When the bottom cover 140 is attached (via mechanical means such as rivets, screws, or adhesive) there is a void or space 184 between the internal side 150 of the bottom cover and the outer surface of the passive radiator 200, which allows the passive radiator to move freely inwardly and outwardly as it fluctuates with sound. As best depicted in FIGS. 11-12, the internal side 150 of the bottom cover 140 is provided with a retention gasket 160 configured to be shaped and dimensioned to correspond and aligned with the radial portion 214 of the flexible element 210 and the underlying radial support region 190 in the chassis 180 that defines the passive radiator aperture. The retention gasket 160 is also dimensioned in height so that its distal surface presses firmly on the radial portion 214 of the flexible element 210 to firmly sandwich the radial perimeter portion 214 of the flexible element 210 against the underlying radial support region 190 of the chassis 180 when the bottom cover 140 is secured to the chassis 180. Such a construction is easily assembled and capable of providing additional integrity to the passive radiator/speaker chassis seal while also providing the needed space 184 to allow the passive radiator to pulsate freely during operation yet also be protected by the perforated bottom cover 140.

The retention gasket 160 can be formed of continuous or non-continuous segments such as that depicted in FIGS. 11-12. A portion of the retention gasket 160 can be configured to have a locking mechanism (e.g., click) to lock the bottom cover 140 and the chassis 180 when the speaker is fully assembled. The retention gasket 160 can be made of a flexible but firm material such as plastic or metal or other suitable material. Its distal surface can include a slight curvature which may be helpful in avoiding tearing of the passive radiator. Alternatively, the distal surface of the retention gasket 160 may have various shapes (hills, valleys, ridges, etc.) or combinations of shapes. The outer surface of the opposing radial support region 190 may have a corresponding shape to that of the mating distal surface of the retention gasket 160 to facilitate a more firm attachment. The retention gasket 160 may be attached in any suitable manner to the internal side 150 of the bottom cover 140, may be integrally formed to the internal side of the bottom cover 140 or may be entirely detachable or independent from the internal side 150 of the bottom cover 140. It is contemplated that portions of the retention gasket 160 may be attached or integral to the bottom cover 140 while other portions may be detachable or independent. It is also contemplated that the retention gasket 160 may be secured directly and/or independently to the underlying radial support region 190 of the speaker chassis 180 via screws or other suitable mechanical or adhesive means. In such a construction the bottom cover 140 may provide additional support to the retention gasket 160.

While the invention has been described in connection with specific examples and various embodiments, it should be readily understood by those skilled in the art that many modifications and adaptations of the invention described herein are possible without departure from the spirit and scope of the invention as claimed hereinafter. Thus, it is to be clearly understood that this application is made only by way of example and not as a limitation on the scope of the invention claimed below. The description is intended to cover any variations, uses or adaptation of the invention following, in general, the principles of the invention, and including such departures from the present disclosure as come within the known and customary practice within the art to which the invention pertains.

The invention claimed is:

1. A portable wireless battery powered speaker comprising:

a chassis defining an internal compartment and having a space defined by a radial support surface of the chassis and a bottom cover, wherein the chassis further comprises a bottom side, and wherein the chassis comprises a plurality of steps from the radial support surface to the bottom side, including at least a first step on the radial support surface and a last step on the bottom side;

one or more active drivers mounted to said chassis;

a retention gasket having a distal surface, the retention gasket secured to said chassis and disposed within the space defined by the radial support surface and the bottom cover;

a passive radiator having an outer perimeter portion that is fixedly held in position between said distal surface of retention gasket and said first step of the radial support surface of said chassis with compressive force against the outer perimeter of said passive radiator; and wherein the bottom cover is attached to at least the last step on the bottom side of the chassis.

2. The portable speaker of claim 1, wherein the passive radiator comprises a flexible outer perimeter portion surrounding a more rigid central region.

3. The portable speaker of claim 1, wherein the chassis, the one or more active drivers, and the passive radiator define a sealed compartment when the portable speaker is fully assembled.

4. The portable speaker of claim 1, wherein the retention gasket is integrally formed with a perforated cover dimensioned to overlie a surface of said passive radiator and having a surface spaced apart from said passive radiator.

5. The portable speaker of claim 1, wherein the retention gasket is secured directly to the chassis.

6. The portable speaker of claim 5, wherein the retention gasket is formed of non-continuous segments.

7. The portable speaker of claim 5, wherein the retention gasket is formed of a continuous segment that corresponds in radial dimensions with the outer perimeter portion of the passive radiator.

8. The portable speaker of claim 1, wherein the retention gasket is secured outside of the outer perimeter portion of said passive radiator relative to said internal compartment.

9. The portable speaker of claim 1, wherein the retention gasket is formed at least in part of plastic.

10. The portable speaker of claim 1, wherein the retention gasket includes a locking mechanism that locks the retention gasket to the chassis when the portable speaker is fully assembled.

11. The portable speaker of claim 1, wherein the distal surface of the retention gasket includes a curved shape.

12. The portable speaker of claim 1, wherein the distal surface of the retention gasket includes ridges that correspond in shape and dimension to ridges on the opposing radial support surface.

13. The portable speaker of claim 1, further comprising a perforated cover dimensioned to overlie the external surface of said passive radiator and spaced apart from said passive radiator.

14. A portable wireless battery powered speaker comprising:

a chassis defining an internal compartment and having a space between a bottom cover and a radial support surface of the chassis; wherein the chassis further comprises a bottom side, and wherein the chassis comprises a plurality of steps from the radial support surface to the bottom side, including at least a first step on the radial support surface and a last step on the bottom side;

one or more active drivers mounted to said chassis;

a retention means secured to said chassis, the retention means located in the space between the bottom cover and the radial support surface of the chassis; and a passive radiator having an outer perimeter portion, the outer perimeter portion being fixedly held in position between the retention means and the radial support surface of the chassis with compressive force against the outer perimeter portion of the passive radiator.

15. The portable speaker of claim 14, wherein the passive radiator comprises a flexible outer perimeter portion surrounding a more rigid central region.

16. The portable speaker of claim 14, wherein the chassis, the one or more active drivers, and the passive radiator define a sealed compartment when the portable speaker is fully assembled.

17. The portable speaker of claim 14, wherein the retention means is integrally formed with a perforated cover dimensioned to overlie a surface of said passive radiator and having a surface spaced apart from said passive radiator.

18. The portable speaker of claim 14, wherein the retention means is secured directly to the chassis.

19. The portable speaker of claim 18, wherein the retention means is formed of non-continuous segments.

20. The portable speaker of claim 18, wherein the retention means is formed of a continuous segment that corresponds in radial dimensions with the outer perimeter portion of the passive radiator.

* * * * *